US008671713B2

(12) United States Patent
Cho

(10) Patent No.: US 8,671,713 B2
(45) Date of Patent: Mar. 18, 2014

(54) AIR CONDITIONER

(75) Inventor: Eun Jun Cho, Changwon-si (KR)

(73) Assignee: LG Electronics Inc., Seoul (KR)

( * ) Notice: Subject to any disclaimer, the term of this patent is extended or adjusted under 35 U.S.C. 154(b) by 232 days.

(21) Appl. No.: 13/382,481

(22) PCT Filed: Jun. 10, 2010

(86) PCT No.: PCT/KR2010/003718

§ 371 (c)(1),
(2), (4) Date: Mar. 23, 2012

(87) PCT Pub. No.: WO2011/004969

PCT Pub. Date: Jan. 13, 2011

(65) Prior Publication Data

US 2012/0174614 A1 Jul. 12, 2012

(30) Foreign Application Priority Data

Jul. 7, 2009 (KR) ..... 10-2009-0061808

(51) Int. Cl.
*F25B 43/02* (2006.01)

(52) U.S. Cl.
USPC ..... 62/498; 62/196.2; 62/510

(58) Field of Classification Search
None
See application file for complete search history.

(56) References Cited

U.S. PATENT DOCUMENTS

| | | | | |
|---|---|---|---|---|
| 6,405,551 | B1 * | 6/2002 | Kuwabara et al. | 62/238.7 |
| 7,541,009 | B2 * | 6/2009 | Takao et al. | 422/198 |

FOREIGN PATENT DOCUMENTS

| | | | |
|---|---|---|---|
| CN | 2612905 | Y | 4/2004 |
| CN | 1500193 | A | 5/2004 |
| CN | 101326409 | A | 12/2008 |
| EP | 1215450 | | 6/2002 |
| JP | 2004-251558 | | 9/2004 |
| JP | 2005-112247 | | 4/2005 |
| WO | WO 2007-046332 | | 4/2007 |

* cited by examiner

*Primary Examiner* — Melvin Jones
(74) *Attorney, Agent, or Firm* — McKenna Long & Aldridge LLP

(57) ABSTRACT

According to the present invention, an air condition comprises: a first compressor and a second compressor which compress a refrigerant through multiple stages; a condenser which condenses the refrigerant compressed by the second compressor; a first flow channel through which a portion of the refrigerant condensed by the condenser passes, in order to be cooled; a supercooling heat exchanger having a second flow channel for exchanging heat with the first flow channel; an expansion instrument which expands the refrigerant cooled by the supercooling heat exchanger; a shell-tube-type evaporator which evaporates the refrigerant expanded by the expansion instrument, and which is connected to a location requiring cold water via a water pipe to supply cold water to said location requiring cold water; a first bypass channel which guides the refrigerant condensed in the condenser to the second flow channel; a supercooling expander installed in the first bypass channel; and a second bypass channel which interconnects the first and second compressors and the second flow channel, thereby decreasing discharge superheat, and thus increasing the degree of subcooling, and improving the efficiency of supplying cold water.

13 Claims, 5 Drawing Sheets

AIR CONDITIONER

This Application is a 35 U.S.C. §371 National Stage Entry of International Application No. PCT/KR2010/003718, filed on Jun. 10, 2010, which claims the benefit of priority of Korean Application No: 10-2009-0061808, filed Jul. 7, 2009, both of which are hereby incorporated by reference in their entirety for all purposes as if fully set forth herein.

TECHNICAL FIELD

The present invention relates to an air conditioner and, more particularly, to an air conditioner in which a plurality of compressors compress a refrigerant through multiple stages.

BACKGROUND ART

In general, an air conditioner is a device for cooling or heating an indoor area by using a refrigerating cycle of a refrigerant including a compressor, a condenser, an expansion instrument, and an evaporator in order to provide an agreeable and comfortable indoor environment to users.

In an air conditioner, an evaporator is configured to heat-exchange water and a refrigerant, a cold water coil through which water heat-exchanged with the refrigerant passes is provided, and when an air blower circulates indoor air to the cold water coil, air heat-exchanged with water cools the indoor area.

When the air conditioner operates, the compressor is turned on, and when the air condition is stopped, the compressor is turned off. When the compressor is turned on, cold water cools air to cool the indoor area, and here, when the degree of discharge superheat of the compressor is high, efficiency is lowered and a liquid refrigerant flows into the compressor.

DISCLOSURE

Technical Problem

Therefore, an object of the present invention is to provide an air conditions capable of increasing the degree of supercool and enhancing efficiency by minimizing the degree of discharge superheat.

Technical Solution

According to an aspect of the present invention, there is provided an air conditioner including: a first compressor which compresses a refrigerant; a second compressor which compresses the refrigerant compressed by the first compressor; a condenser which condenses the refrigerant compressed by the second compressor; a supercooling heat exchanger including a first flow channel through which a portion of the refrigerant condensed by the condenser passes in order to be cooled, and a second flow channel for heat exchanging heat with the first flow channel; an expansion instrument which expands the refrigerant cooled by the supercooling heat exchanger; a shell-tube-type evaporator which includes a shell allowing the refrigerant to pass therethrough and a tube disposed within the shell and allowing water to be heat-exchanged with the shell to pass therethrough, which evaporates the refrigerant expanded by the expansion instrument, and which is connected to a location requiring cold water via a water pipe to supply cold water to the location requiring cold water; a first bypass channel which guides the refrigerant condensed in the condenser to the second flow channel; a supercooling expander installed in the first bypass channel; and a second bypass channel which interconnects the first and second compressors and the second flow channel to allow the refrigerant passing through the second flow channel to be mixed with the refrigerant compressed by the first compressor so as to be compressed in the second compressor.

The condenser may be a shell-tube-type heat exchanger including a shell allowing any one of a refrigerant and water to pass therethrough and a plurality of inner tubes allowing the other of the refrigerant and water to pass therethrough and disposed within the shell.

The condenser may be connected to a cooling top by a coolant pipe.

The location requiring cold water may be configured as a cold water coil having a water flow channel allowing water to pass therethrough, to which the water pipe is connected, and the air conditioner may further include: a blow fan blowing a mixture of indoor air and outdoor air to the cold water coil.

A compressor connection pipe may be provided to connect the first and second compressors.

The second bypass channel may be connected to the compressor connection pipe.

The supercooling heat exchanger may be formed such that the refrigerant of the first flow channel and that of the second flow channel move in the mutually opposite directions.

An oil recover flow channel may be provided to recover oil of the shell-tube-type evaporator to the first and second compressors.

The oil recovery flow channel may include an evaporator connection flow channel connected to the shell-tube-type evaporator, a first compressor connection flow channel connecting the evaporator connection flow channel and the first compressor, and a second compressor connection flow channel connecting the evaporator connection flow channel and the second compressor.

A capillary tube may be installed in the evaporator connection flow channel.

The expansion instrument may be connected to the first flow channel of the supercooling heat exchanger by a supercooling heat exchanger-expansion instrument connection pipe.

The supercooling expander may be an electronic expansion valve expanding the refrigerant passing through the first bypass channel by pressure between a condensation pressure and an evaporation pressure.

The air conditioner may further include: a cold water pump installed in the water pipe; a manipulation unit manipulated by a user; and a controller operating the first and second compressors, the expansion instrument, the supercooling expander, and the cold water pump according to a manipulation of the manipulation unit.

Advantageous Effects

According to embodiments of the present invention, since the refrigerant obtained by supercooling the refrigerant in the supercooling heat exchanger is mixed with the refrigerant compressed in the first compressor and compressed in the second compressor, the degree of discharge superheat is reduced, and accordingly, since the degree of supercool is increased, cold water supply efficiency can be enhanced.

BEST MODES

An embodiment of the present invention will be described in detail with reference to the accompanying drawings.

Figure 1:
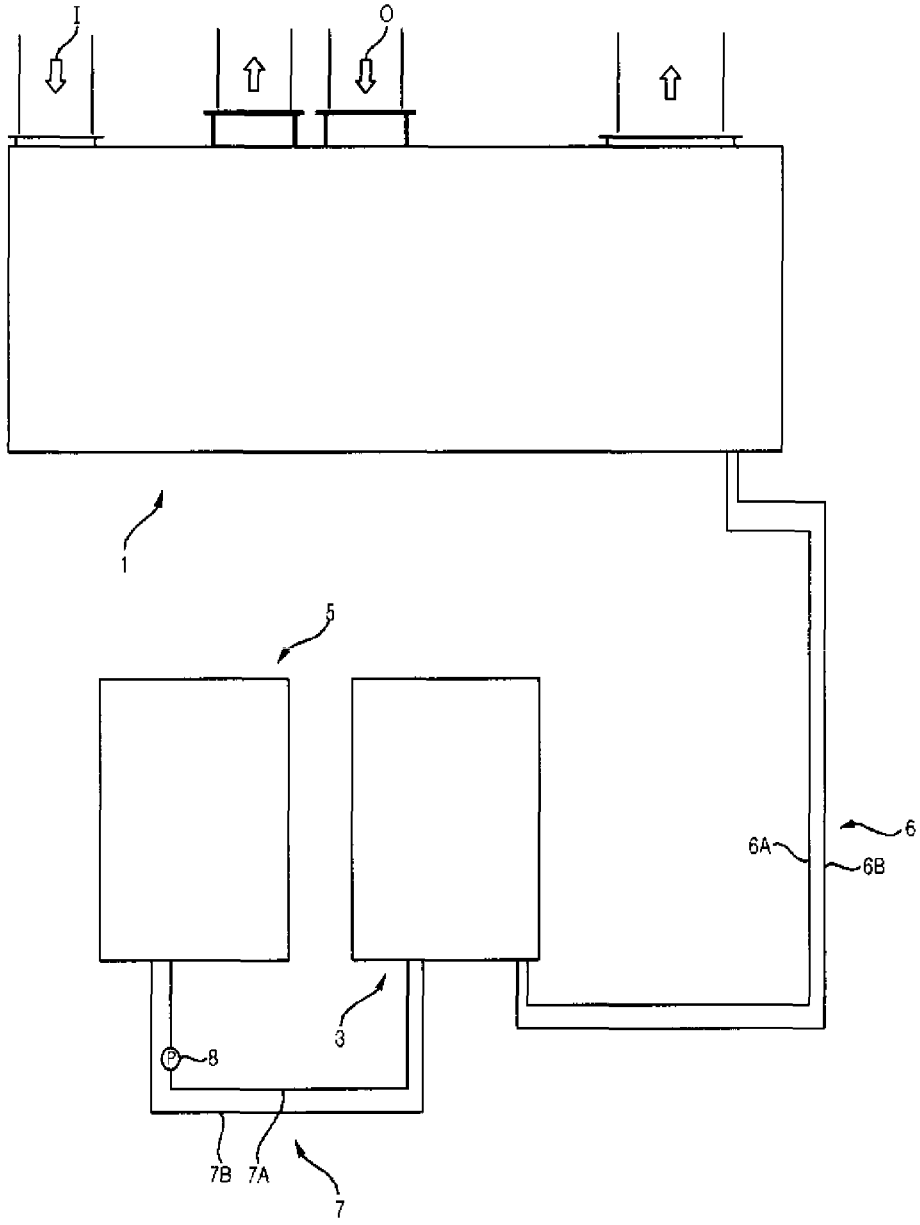
FIG. 1 is a schematic view showing the configuration of an air conditioner according to an embodiment of the present invention.

FIG. 1 is a schematic view showing the configuration of an air conditioner according to an embodiment of the present invention.

The air conditioner according to an embodiment of the present invention includes an air handling unit 1, a chiller 3, and a cooling top 5. The air handling unit 1 and the chiller 3 are connected by a water pipe 6, and the chiller 3 and the cooling top 5 is connected by a coolant pipe 7.

The air handling unit 1 is an air conditioning unit sucking indoor air, heat-exchanging it, and then, discharging the heat-exchanged air to an indoor area. The air handling unit 1 may be configured as a combination ventilation and air-conditioning unit or as a non-ventilation air-conditioning unit.

When the air handling unit 1 is configured as a combination ventilation and air conditioning unit, it sucks indoor air I and outdoor air O, discharges a portion of the sucked indoor air to the outside, mixes remaining indoor air with outdoor air, heat-exchanges the mixed air to a location requiring cold water (referred to as a 'cold water coil', hereinafter) such as a cold water coil, or the like, and then, supplies the heat-exchanged air to the indoor area, and when the air handling unit 1 is configured as a non-ventilation air conditioning unit, it sucks the indoor air, heat-exchanges the sucked air in the cold water coil, and then, supplies the heat-exchanged air to the indoor area.

The air handling unit 1 includes a cold water coil having a water flow channel allowing water to pass therethrough and a blow fan circulating and blowing a mixture of indoor air and outdoor air or indoor air to the cold water coil.

When the air handling unit 1 is configured as a combination ventilation and air conditioning unit, it may be installed in an air-conditioning chamber, a mechanic chamber, or the like, separately prepared from the indoor area air-conditioned by the air handling unit 1 in a building in which the air conditioner is installed, or may be installed in an outdoor area.

When the air handling unit 1 is configured as a non-ventilation and air conditioning unit, it may be configured as a fan coil unit (FCU) installed in an indoor area air-conditioned by the air handling unit 1, directly sucks indoor air to heat-exchange it in the cold water coil, and directly discharges the heat-exchanged air to the indoor area.

When the air handling unit 1 is configured as a non-ventilation air conditioning unit, it may be configured as a floor cooling pipe installed in the floor to cool the floor of the indoor area.

The chiller 3 is a sort of cold water supply unit which supplies cold water to the cold water coil of the air handling unit 1 by using a refrigerating cycle comprised of a compressor, a condenser, an expansion instrument, and an evaporator.

The chiller 3 may be installed in an air conditioning chamber or a mechanic chamber of a building in which the air conditioner is installed, or may be installed in an outdoor area.

In the chiller 3, the water pipe 6 is connected to the evaporator, and the coolant pipe 7 is connected to the condenser.

The water pipe 6 includes a cold water outflow pipe 6A allowing cold water cooled by the chiller 3 to be supplied to the air handling unit 1 and a cold water recovery pipe 6B allowing cold water which has passed through the air handling unit 1 to be recovered to the chiller 3.

A cold water pump (not shown) for circulating cold water through the evaporator and the cold water coil is installed in the water pipe 6.

The coolant pipe 7 includes a coolant inlet pipe 7A allowing a coolant of the cooling top 5 to be introduced into the condenser and a coolant outlet pipe 7B allowing the coolant flowing out from the condenser of the chiller 3 to be recovered into the cooling top 5.

A coolant pump 8 for pumping the coolant to allow the coolant to be circulated through the cooling top 5 and the condenser of the chiller 3 is installed on the coolant pipe 7.

The coolant pump 8 is connected to a controller 74 (to be described) s as to be controlled.

Figure 2:
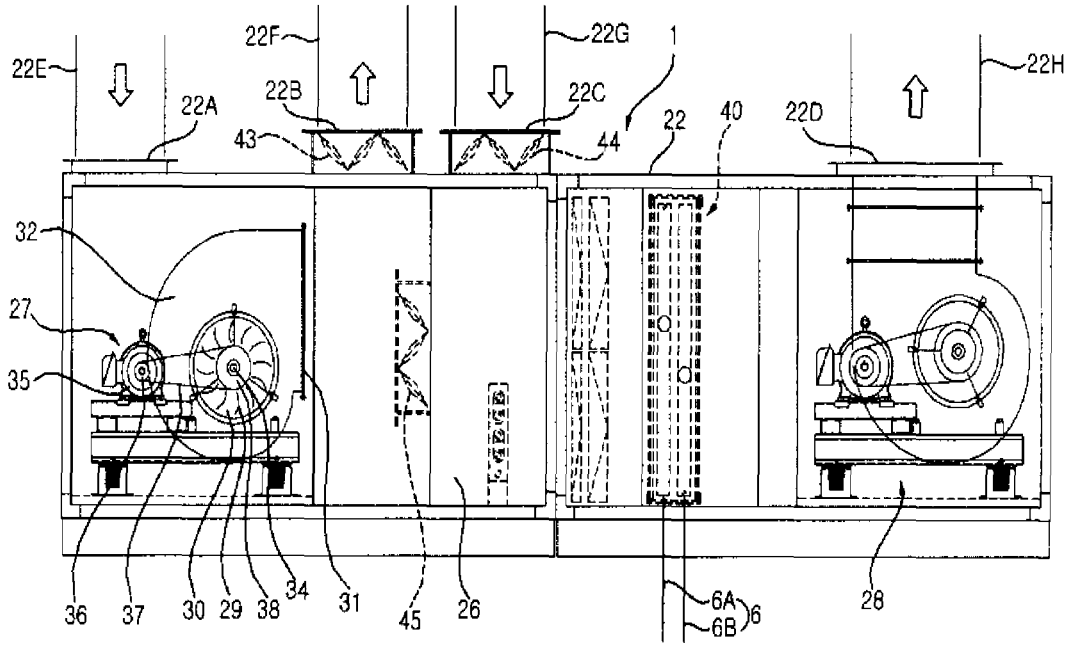
FIG. 2 is a sectional view of an air handling unit illustrated in FIG. 1.

FIG. 2 is a side view of the air handling unit illustrated in FIG. 1.

The air handling unit 1 includes a handling unit case 22 having a space therein and including an indoor air suction unit 22A, an indoor air discharge unit 22B, an external air suction unit 22C, and an air conditioned air discharge unit 22D.

The air handling unit 1 includes blow fans 27 and 28 installed within the air handling unit case 22 and moving outdoor air and indoor air, and a cold water coil 40 installed within the air handling unit case 22 and heat-exchanging air moving toward the air conditioned air discharge unit 22D with cold water.

A ventilation duct 22E is connected to the air handling unit 1 in order to allow the indoor area and the indoor air suction unit 22A to communicate therethrough, whereby indoor air is sucked into the air handling unit case 22 through the indoor air suction unit 22A.

An exhaust duct 22F is connected to the air handling unit 1 in order to allow the indoor air discharge unit 22B and the outdoor area to communicate therethrough, whereby a portion of air sucked into the air handling unit case 22 through the indoor air suction unit 22A is discharged to an outdoor area.

An external air duct 22G is connected to the air handling unit 1 in order to allow the outdoor area and the outdoor air suction unit 22 to communicate therethrough, whereby outdoor air is sucked into the air handling unit case 22 through the outdoor air suction unit 22C.

An air supply duct 22H is connected to the air handling unit 1 in order to allow the air-conditioned air discharge unit 22D and the indoor area to communicate therethrough, whereby air air-conditioned within the air handling unit case 22 is supplied to the indoor area.

The ventilation duct 22E is connected to the indoor air suction unit 22A. The exhaust duct 22F is connected to the indoor air discharge unit 22B. The external air duct 22G is connected to the outdoor air suction unit 22C. The air supply duct 22H is connected to the air-conditioned air discharge unit 22D.

The air handling unit 1 is configured such that a portion of indoor air sucked through the indoor air suction unit 22A is exhaust to the outdoor area through the indoor air discharge unit 22B, the remaining indoor air is mixed with outdoor air sucked through the external air suction unit 22C, and the mixed air is heat-exchanged with the cold water coil 40, and then, supplied to the indoor area through the air-conditioned air discharge unit 22D and the air supply duct 22H.

In the air handling unit 1, a mixing chamber 26 in which indoor air and outdoor air are mixed is positioned before the cold water coil 40 in an air movement direction.

The blow fans 27 and 28 include a return fan 27 positioned between the indoor air suction unit 22A and the indoor air discharge unit 22B in the direction in which indoor air moves, to suck indoor air into the air handling unit case 22 and blow it, and a supply fan 28 positioned between the cold water coil 40 and the air-conditioned air discharge unit 22D in a direction in which mixed air moves, to suck mixed air into the cold water coil 40 and blow it toward the air-conditioned air discharge unit 22D.

The blow fans 27 and 28 are air volume variable blow fans which can adjust an air volume and include a blower 29, a housing 32 including an air suction hole 30 and an air discharge hole 31 formed to surround the blower 29, and a blower driving source 33 rotating the blower 29.

The blower driving source 33 may be configured as a motor having a rotational shaft connected to a rotation center of the blower 29, and may be comprised of a shaft 34 connected to the rotation center of the blower 29, a motor 35 installed to be positioned at an outer side of the housing 32, and a power transmission member transmitting power of the motor 35 to the shaft 34.

The power transmission member may include a driving pulley 36 installed on the rotational shaft of the motor 35, a follower pulley 38 installed on the shaft 34, and a belt 37 wound around the driving pulley 35 and the follower pulley 38.

The motor 35 is configured as an inverter motor which can vary the revolutions per minute (rpm) of the blower 29.

The cold water coil 40 is a sort of an indoor heat exchanger heat-exchanging mixed air and cold water to cool mixed air. The cold water coil 40 is installed between the mixing chamber 26 and the supply fan 27.

The air handling unit 1 includes dampers 43, 44, and 45 which regulate the ratio between indoor air and outdoor air of the mixed air.

The dampers 43, 44, and 45 include an exhaust damper 43 installed in the indoor air discharge unit 22B to regulate indoor air exhaust amount, an external air damper 44 installed in the external air suction unit 22C to regulate outdoor air intake amount, and a mixing damper 45 installed in the mixing chamber 26 to regulate an amount of air, in the indoor air, sucked into the mixing chamber 26

Figure 3:
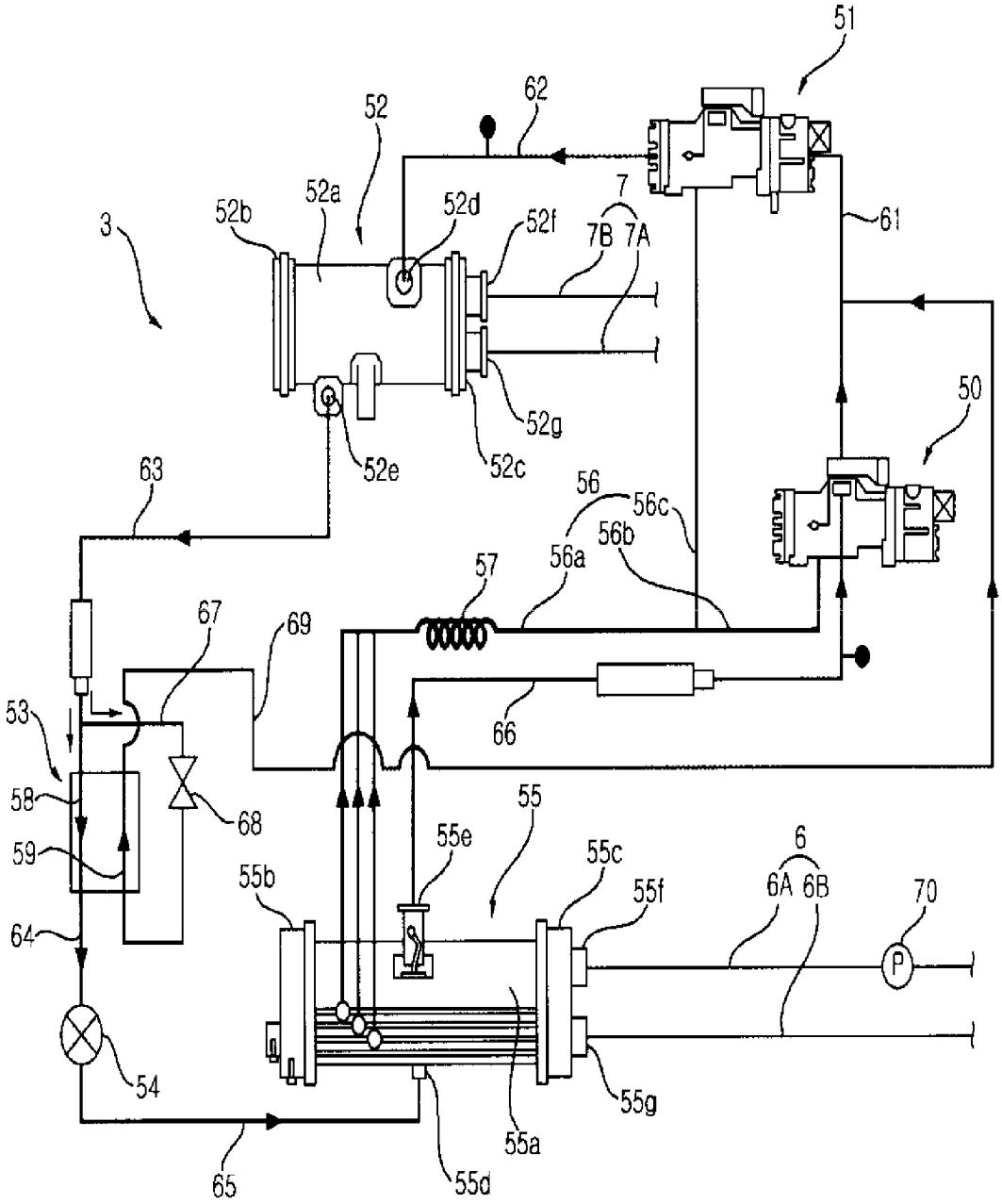
FIG. 3 is a schematic view showing a chiller illustrated in FIG. 1.

FIG. 3 is a schematic view showing the chiller illustrated in FIG. 1.

The chiller 3 includes a plurality of compressors 50 and 51, a condenser 52, a supercooling heat exchanger 53, an expansion instrument 54, and an evaporator 55.

The compressors 50 and 51, the condenser 52, the supercooling heat exchanger 53, the expansion instrument 54, and the evaporator 55 are installed within a single chiller case (not shown) so as to be integrated into a single unit.

The plurality of compressors 50 and 51 compress a refrigerant through multiple stages. Each of the compressors 50 and 51 may be configured as a capacity variable compressor whose compression capacity is varied, or may be configured as a constant speed compressor whose compassion capacity is fixed. The compressors 50 and 51 may be configured as a reciprocal compressor, a rotary compressor, an inverter compressor, a screw compressor, or the like, respectively.

The number of the plurality of compressors 50 and 51 is not limited, but hereinafter, a case in which the compressors 50 and 50 include a first compressor 50 which compresses a refrigerant and a second compressor 51 which compresses the refrigerant which has been compressed by the first compressor 50 will be described.

A discharge side of the first compressor 50 and a suction side of the second compressor 51 are connected by a compressor connection pipe 61.

The condenser 52 is a heat-exchanger which condenses a refrigerant by a coolant supplied from the cooling top 5 illustrated in FIG. 1.

The condenser 52 is a shell-tube-type heat exchanger including a shell 52*a* allowing any one of a refrigerant and water to pass therethrough, a plurality of partitions (not shown) blocking both ends of the shell 52*a*, a plurality of caps 52*b* and 52*c* covering both ends of the shell 52*a*, and a plurality of inner tubes (not shown) disposed to allow the other of the refrigerant and water to pass therethrough to penetrate the plurality of partitions so as to communicate with the interior of the caps 52*b* and 52*c*.

Preferably, the condenser 52 is configured to allow water to pass through the plurality of caps 52*b* and 52*c* and the inner tubes and the refrigerant to pass through the shell 52*a* and the plurality of inner tubes.

The condenser 52 includes a refrigerant inlet 52*d* through which a refrigerant is introduced into the shell 52*a* and a refrigerant outlet 52*e* through which the refrigerant flows out.

A compressor-condenser connection pipe 62 connecting the second compressor 51 and the condenser 52 is connected to the refrigerant inlet 52*d* of the condenser 52.

A condenser-supercooling heat exchanger connection pipe 63 connecting the condenser 52 and a first flow channel 58 (to be described) of the supercooling heat exchanger 53 is connected to the refrigerant outlet 52*e* of the condenser 52.

The condenser 52 includes a coolant outlet 52*f* to which a refrigerant outlet pipe 7B of the coolant pipe 7 illustrated in FIG. 1 is connected and a coolant inlet 52*g* to which a coolant inlet pipe 7A of the coolant pipe 7 is connected. The coolant outlet 52*f* and the coolant inlet 52*g* are formed on at least one of the plurality of caps 52*b* and 52*c* of the condenser 52.

Namely, as for the condenser 52, when the coolant pump 8 illustrated in FIG. 1 is driven, the condenser 52, the coolant cooled in the cooling top 5 is introduced into the condenser 52 to condense the refrigerant compressed by the compressor 51 and then circulated to the cooling top 5, and the refrigerant in the condensed state flows to the condenser-supercooling heat exchanger connection pipe 63.

The supercooling heat exchanger 53 includes a first flow channel 58 through which a portion of the refrigerant condensed in the condenser 52 passes to be cooled and a second flow channel 59 heat-exchanged with the first flow channel 58.

The first flow channel 58 is a cooling flow channel through which a portion of the refrigerant condensed in the condenser 52 passes to be cooled by the refrigerant which passes through the second flow channel 59 so as to be supercooled.

The second flow channel 59 is a heat suction flow channel which cools the remaining refrigerant, which does not flow to the first flow channel 58 from the condenser 52, passing through the first flow channel 58.

The supercooling heat exchanger 53 is formed such that the refrigerant of the first flow channel 58 and that of the second flow channel 59 to move in the mutually opposite directions.

The supercooling heat exchanger 53 may be configured as a dual-pipe heat exchanger in which any one of the first flow channel 58 and the second flow channel 59 covers the other, and may be configured as a plate type heat exchanger in which the first flow channel 58 and the second flow channel 59 are alternately formed with an electric plate interposed therebetween.

The expansion instrument 54 expands the refrigerant cooled in the supercooling heat exchanger 53, which is configured as a capillary tube or an electronic expansion valve (EEV).

The expansion instrument 54 is connected to the first flow channel 58 of the supercooling heat exchanger 53 by a supercooling heat exchanger-expansion instrument connection pipe 64.

The evaporator 55 is a water cooler which cools water by evaporating the refrigerant expanded in the expansion instrument 54, in which a refrigerant flow channel allowing a refrigerant to pass therethrough and a water flow channel allowing water to pass therethrough are formed with a heat exchanging member interposed therebetween.

The evaporator 55 is a shell-tube-type heat exchanger including a shell 55*a* allowing any one of a refrigerant and water to pass therethrough, a plurality of partitions (not shown) blocking both ends of the shell 55*a*, a plurality of caps 55*b* and 55*c* covering both ends of the shell 55*a*, and a plurality of inner tubes (not shown) disposed to allow the other of the refrigerant and water to pass therethrough to penetrate the plurality of partitions so as to communicate with the interior of the caps 55*b* and 55*c*.

Preferably, the evaporator 55 is configured to allow water to pass through the plurality of caps 55*b* and 55*c* and the inner tubes and the refrigerant to pass through the shell 55*a* and the plurality of inner tubes.

The evaporator 55 includes a refrigerant inlet 55*d* through which a refrigerant is introduced into the shell 55*a* and a refrigerant outlet 55*e* through which the refrigerant flows out.

The refrigerant inlet 55*d* of the evaporator 55 is connected to the expansion instrument 54 by an expansion instrument-evaporator connection pipe 65.

The refrigerant outlet 53 of the evaporator 55 is connected to the first compressor 50 among the plurality of compressors 50 and 51 by an evaporator-compressor connection pipe 66.

A cold water outlet 55*f* to which the cold water outlet pipe 6A of the water pipe 6 illustrated in FIG. 1 is connected and a cold water recovery hole 55*g* to which the cold water recovery pipe 6B is connected are formed on at least one of the plurality of caps 55*b* and 55*c* of the evaporator 55.

Namely, as for the evaporator 55, cold water cooled by the refrigerant is supplied to the air handling unit 1 through the water pipe 6 illustrated in FIG. 1 and then circulated to the evaporator 55, and the refrigerant in the evaporated state moves to the first compressor 51.

In the evaporator 55, the refrigerant is filled between the inner tubes and the shell 55*a*, and oil is positioned on an upper surface of the liquid refrigerant, and such oil is recovered into the first compressor 50 and the second compressor 51 through the oil recovery flow channel 56.

The oil recovery flow channel 56 includes an evaporator connection flow channel 56*a* connected to the evaporator 55, a first compressor connection flow channel 56*b* connecting the evaporator connection flow channel 56*a* and the first compressor 50, and a second compressor connection flow channel 56*c* connecting the evaporator connection flow channel 56*a* and the second compressor 51.

An expansion instrument 57 such as a capillary tube, an electronic expansion valve (EEV), or the like, is installed in the evaporator connection flow channel 56*a*.

The air conditioner according to the present embodiment further includes a first bypass channel 67 guiding the refrigerant condensed by the condenser 52 to the second flow channel, a supercooling expander 68 installed in the first bypass channel 67, and a second bypass channel 69 connecting the first compressor 50, the second compressor 51, and the second flow channel 59 to allow the refrigerant passing through the second flow path to be mixed with the refrigerant compressed in the first compressor 50 so as to be compressed in the second compressor 51.

One end of the first bypass channel 67 is connected to the condenser-supercooling heat exchanger connection pipe 62, and the other end thereof is connected to the second flow channel 69 of the supercooling heat exchanger 53.

The supercooling expander 68 expands the refrigerant passing through the first bypass channel 67 by pressure between condensation pressure and evaporation pressure, and may be configured as a capillary tube or an EEV.

One end of the second bypass channel 69 is connected to the second flow channel 59 of the supercooling heat exchanger 53, and the other end thereof is connected to the compressor connection pipe 61.

Namely, a portion of the refrigerant condensed in the condenser 52 is supercooled, while passing through the first flow channel 58 of the supercooling heat exchanger 53.

The other remaining refrigerant not moving to the first flow channel 58 of the supercooling heat exchanger 53, of the refrigerant condensed in the condenser 52, is expanded in the supercooling expander 68, while passing through the first bypass flow channel 67, takes heat from the refrigerant of the first flow channel 58, while passing through the second flow channel 59, and then flows to the compressor connection pipe 61 through the second bypass channel 69.

The degree of superheat of the refrigerant flowing to the compressor connection pipe 61 through the first bypass channel 67, the supercooling expander 68, and the second bypass channel 69 is regulated by a difference in the temperature of the suction side of the second compressor 51 and the temperature between the second flow channel 59 and the supercooling expander 58 of the supercooling heat exchanger 53.

Meanwhile, the cold water pump 70 for pumping cold water to circulate it in the water pipe 6 is installed in the chiller 3.

The cold water pump 70 may be installed at portion positioned within the air handling unit 1 in the water pipe 6, at a portion positioned within the chiller 3, at a portion positioned between the air handling unit 1 and the chiller 3, or preferably, installed to be positioned within the air handling unit 1 or within the chiller 3 so as to be easily controlled or easily connected to an electric wire, or the like.

The cold water pump 70 is connected to the controller 75 (to be described) through a communication line, so as to be controlled.

Figure 4:
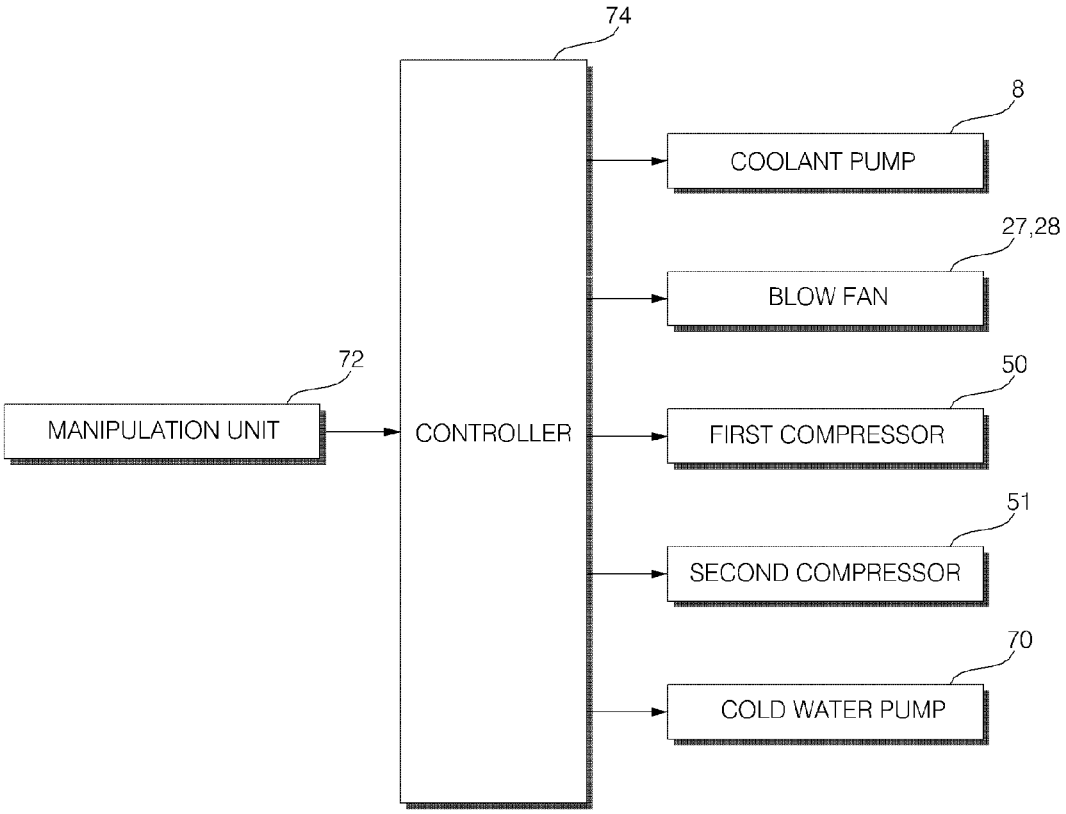
FIG. 4 is a control block diagram of the air conditioner according to an embodiment of the present invention.

FIG. 4 is a control block diagram of the air conditioner according to an embodiment of the present invention; and The air conditioner further includes a manipulation unit 72 manipulated by a user, and the controller 74 controlling the air conditioner according to a manipulation of the manipulation unit 72.

The manipulation unit 72 includes an operation/stop input unit, a desired temperature input unit, and the like.

The controller 74 operates the coolant pump 8, the blow fans 27 and 28, the first and second compressors 50 and 51, the expansion instrument 54, the supercooling expander 68, the cold water pump 70, and the like, according to a manipulation of the manipulation unit 72.

The operation of the present invention configured as described above will be described as follows.

First, when the air conditioner is manipulated by the manipulation unit 72, the controller 74 drives the blow fans 27 and 28 of the air handling unit 1, and the first compressor 50, the second compressor 51, the cold water pump 70, and the coolant pump 8 of the chiller.

When the coolant pump 8 is driven, the coolant of the cooling top 5 is circulated through the cooling top 5 and the condenser 52 to cool the condenser 52.

When the cold water pump 70 is driven, cold water is circulated through the cold water coil 40 of the air handling unit 1 and the evaporator 55 of the chiller 3, so as to be cooled by the evaporator 55.

When the compressor 51 is driven, the blow fans 27 and 28 of the air handling unit 1 are driven, a portion of indoor air I is discharged to the outdoor area, and the remaining air is mixed with outdoor air O, cooled while passing through the cold water coil 40, and then, discharged to the indoor area.

When the first and second compressors 50 and 51 are driven, the compressed refrigerant moves into the condenser 52 through the compressor-condenser connection pipe 62 so as to be condensed in the condenser 52, and a portion of the condensed refrigerant flows to the first flow channel 58 of the supercooling heat exchanger 53 through the condenser-supercooling heat exchanger connection pipe 62, and the other remaining refrigerant of the condensed refrigerant is expanded by the supercooling expander 68 through the condenser-supercooling heat exchanger connection pipe 62 and the first bypass channel 67, and then flows to the second flow channel 59 of the supercooling heat exchanger 53.

The refrigerant flowing through the second flow channel 59 is expanded by the supercooling expander 68 to have a temperature lower than that of the refrigerant flowing through the first flow channel 58, and as it supercools the refrigerant flowing through the first flow channel 58, while taking heat of the refrigerant flowing through the first flow channel 58, it is overheated.

The refrigerant flowing through the first flow channel 58 of the supercooling heat exchanger 53 flows in a supercooled state to the expansion instrument 54 through the supercooling heat exchanger-expansion instrument connection pipe 64, is expanded by the expansion instrument 54, and then, introduced into the evaporator 55 through the expansion instrument-evaporator connection pipe 65, so as to be evaporated.

The evaporated refrigerant is sucked into and compressed in the first compressor 50 through the evaporator-compressor connection pipe 66, and then, discharged through the compressor connection pipe 61.

Meanwhile, the refrigerant overheated in the second flow channel 59 of the supercooling heat exchanger 53 flows to the compressor connection pipe 61 through the second bypass channel 69, and is mixed with the refrigerant discharged from the first compressor 50 to the compressor connection pipe 61, and compressed in the mixed state by the second compressor 51, and this process is repeatedly performed.

Figure 5:
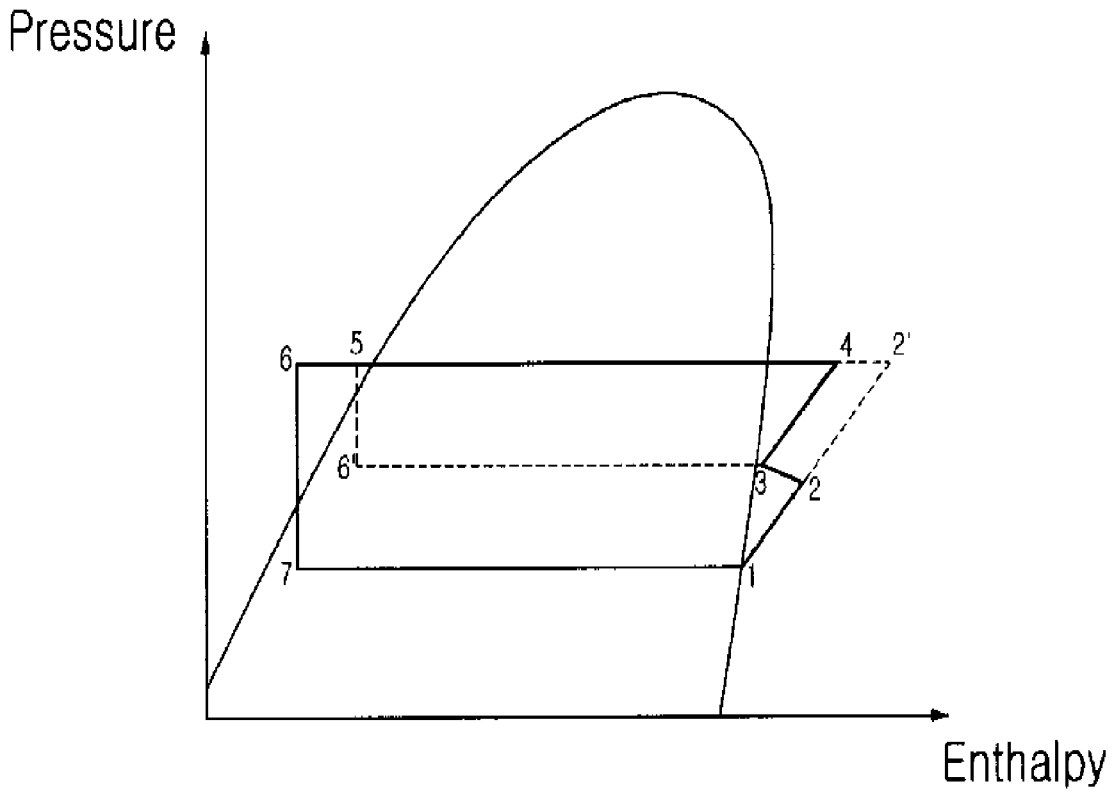
FIG. 5 is a P-h diagram of the air conditioner according to an embodiment of the present invention.

FIG. 5 is a P-h diagram of the air conditioner according to an embodiment of the present invention.

When the air conditioner according to the present embodiment operates, the refrigerant compressed through a process of 3→4 of FIG. 5 in the second compressor 51 is condensed through a process of 4→5 of FIG. 5, a portion of the condensed refrigerant is supercooled through a process of 5→6 of FIG. 5 in the first flow channel 58, and the other remaining refrigerant of the condensed refrigerant is expanded through a process of 5→6' of FIG. 5 in the supercooling expander 68, and then, overheated through a process of 6'→3 of FIG. 5 in the second flow channel 59 of the supercooling heat exchanger 53.

Here, the refrigerant expanded by the supercooling expander 68, of the condensed refrigerant, is expanded by a pressure between a condensation pressure of the condenser 52 and an evaporation pressure of the evaporator 55.

Meanwhile, the refrigerant supercooled in the first flow channel 58 of the supercooling heat exchanger 53 is expanded while passing through the expansion instrument 54 to undergo a process of 6→7 of FIG. 5, and then, evaporated while passing through the evaporator 55 to undergo a process of 7→1 of FIG. 5.

The thusly evaporated refrigerant is compressed by the first compressor 50 to undergo a process of 1→2 of FIG. 5, mixed with the refrigerant which has passed through the second flow channel 59 of the supercooling expander 68 and the supercooling heat exchanger 53, and then, compressed by the second compressor 51.

Meanwhile, when the refrigerant is compressed, the refrigerant compressed in the first and second compressors 50 and 51 does not undergo a process of 1→2→2'→4 but undergo a process of 1→2→3→4. Namely, the degree of discharge superheat according to the driving of the first compressor 50 and the second compressor 51 is reduced by the amount of 2'→4 of FIG. 5, in comparison to the case in which the refrigerant which has passed through the second flow channel 59 of the supercooling expander 68 and the supercooling heat exchanger 53 is sucked to a suction end of the first compressor 50, and thus, since the degree of supercool is increased, the efficiency can be enhanced.

The invention claimed is:

1. An air conditioner comprising:

a first compressor which compresses a refrigerant;

a second compressor which compresses the refrigerant compressed by the first compressor;

a condenser which condenses the refrigerant compressed by the second compressor;

a supercooling heat exchanger including a first flow channel through which a portion of the refrigerant condensed by the condenser passes in order to be cooled, and a second flow channel for heat exchanging heat with the first flow channel;

an expansion instrument which expands the refrigerant cooled by the supercooling heat exchanger;

a shell-tube-type evaporator which includes a shell allowing the refrigerant to pass therethrough and a tube disposed within the shell and allowing water to be heat-exchanged with the shell to pass therethrough, which evaporates the refrigerant expanded by the expansion instrument, and which is connected to a location requiring cold water via a water pipe to supply cold water to the location requiring cold water;

a first bypass channel which guides the refrigerant condensed in the condenser to the second flow channel;

a supercooling expander installed in the first bypass channel; and a second bypass channel which interconnects the first and second compressors and the second flow channel to allow the refrigerant passing through the second flow channel to be mixed with the refrigerant compressed by the first compressor so as to be compressed in the second compressor.

2. The air conditioner of claim 1, wherein the condenser is a shell-tube-type heat exchanger including a shell allowing any one of a refrigerant and water to pass therethrough and a plurality of inner tubes allowing the other of the refrigerant and water to pass therethrough and disposed within the shell.

3. The air conditioner of claim 1, wherein the condenser is connected to a cooling top by a coolant pipe.

4. The air conditioner of claim 1, wherein the location requiring cold water is configured as a cold water coil having a water flow channel allowing water to pass therethrough, to which the water pipe is connected, wherein the air conditioner further comprising:

a blow fan blowing a mixture of indoor air and outdoor air to the cold water coil.

5. The air conditioner of claim 1, wherein a compressor connection pipe is provided to connect the first and second compressors.

6. The air conditioner of claim 5, wherein the second bypass channel is connected to the compressor connection pipe.

7. The air conditioner of claim 1, wherein the supercooling heat exchanger is formed such that the refrigerant of the first flow channel and that of the second flow channel move in the mutually opposite directions.

8. The air conditioner of claim 1, wherein an oil recover flow channel is provided to recover oil of the shell-tube-type evaporator to the first and second compressors.

9. The air conditioner of claim 8, wherein the oil recovery flow channel comprises an evaporator connection flow channel connected to the shell-tube-type evaporator, a first compressor connection flow channel connecting the evaporator connection flow channel and the first compressor, and a second compressor connection flow channel connecting the evaporator connection flow channel and the second compressor.

10. The air conditioner of claim 9, wherein a capillary tube is installed in the evaporator connection flow channel.

11. The air conditioner of claim 1, wherein the expansion instrument is connected to the first flow channel of the supercooling heat exchanger by a supercooling heat exchanger-expansion instrument connection pipe.

12. The air conditioner of claim 1, wherein the supercooling expander is an electronic expansion valve expanding the refrigerant passing through the first bypass channel by pressure between a condensation pressure and an evaporation pressure.

13. The air conditioner of claim 1, further comprising:

a cold water pump installed in the water pipe;

a manipulation unit manipulated by a user; and a controller operating the first and second compressors, the expansion instrument, the supercooling expander, and the cold water pump according to a manipulation of the manipulation unit.

* * * * *